United States Patent [19]

Raasch

[11] Patent Number: 4,702,427

[45] Date of Patent: Oct. 27, 1987

[54] COIL PRODUCING MACHINE

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 915,866

[22] Filed: Oct. 6, 1986

Related U.S. Application Data

[63] Continuation of Ser. No. 830,249, Feb. 18, 1986, abandoned.

[51] Int. Cl.[4] ..... B65H 54/26; B65H 9/18

[52] U.S. Cl. ..... 242/35.5 A; 57/268

[58] Field of Search ..... 242/35.5 A, 35.5 R, 242/35.5 T; 57/266, 268, 270, 281

[56] References Cited

U.S. PATENT DOCUMENTS

| | | | |
|---|---|---|---|
| 3,358,940 | 12/1967 | Beckwith, Jr. et al. | 242/35.5 R |
| 4,023,743 | 5/1977 | Schippers | 242/35.5 A |
| 4,066,218 | 1/1978 | Kamp | 242/35.5 A |
| 4,125,990 | 11/1978 | Stahlecker et al. | 57/270 X |
| 4,283,908 | 8/1981 | Kamp et al. | 57/276 |

*Primary Examiner*—Stuart S. Levy
*Assistant Examiner*—Lynn M. Sohacki
*Attorney, Agent, or Firm*—Herbert L. Lerner; Laurence A. Greenberg

[57] ABSTRACT

Coil producing machine with a mobile exchanging device for replacing full wound coils with empty coil cores or partly wound coils, and with a stationary loading magazine for replenishing the empty coil cores or partly wound coils required by the exchanging device, comprising a mobile coil-core carrier, and means for automatically shuttling said carrier between the exchanging device and the loading magazine.

6 Claims, 6 Drawing Figures

FIG. 1
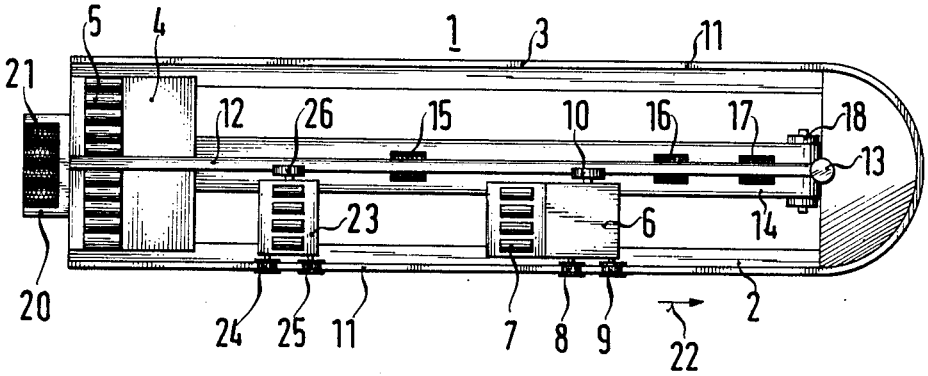
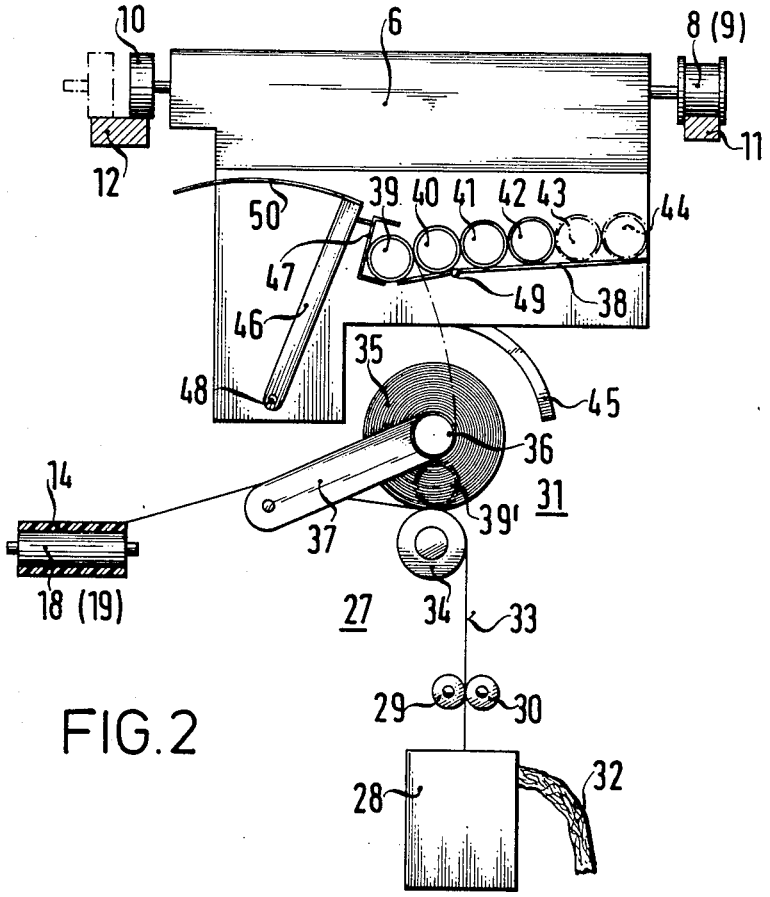
FIG. 2

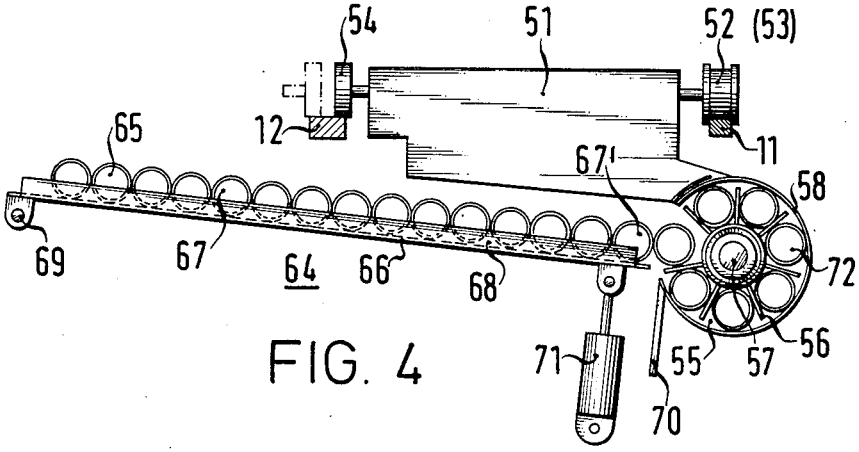
FIG. 4
FIG. 5
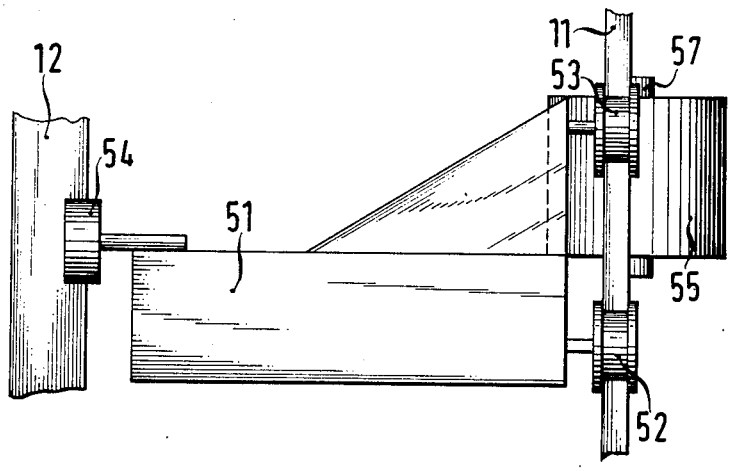

COIL PRODUCING MACHINE

This application is a continuation of application Ser. No. 830,249, filed Feb. 18, 1986, now abandoned.

The invention relates to a coil or bobbin producing machine with a mobile exchanging device for replacing fully wound coils with empty coil cores or partly wound coils, and with a stationary loading magazine for replenishing the empty coil cores or partly wound coils required by the exchanging device.

The coils are produced from textile threads, which are either made of fibrous material at the individual work stations of the coil producing machine, or the coils are formed by rewinding previously existing coils onto other coil cores or tubes.

The coil producing machines accordingly encompass both pure coil winding machines, or also spinning machines and spinning-winding machines, respectively.

The mobile exchanging device of the coil producing machine carries with it a limited supply of empty or partly wound coil cores or tube sleeves, and after they have been given out, the exchanging device must travel to a stationary loading magazine to fill up its own magazine. Because modern coil winding machines have up to about two hundred work stations, the following disadvantages result:

The mobile exchanging device has used up its own coil core supply before it arrives at the stationary loading magazine according to its program. It must then interrupt its activity, and make a special trip to the loading magazine, which might sometimes be quite lengthy. During this travel and during the coil-core transfer at the loading magazine, no coils and coil cores, respectively, can be inserted into the winding devices, so that for larger production machines and during winding of coils with a short winding time, unavoidably long waiting periods occur, which lower the efficiency of the entire coil production machine.

It is accordingly an object of the invention to provide a coil producing machine wherein the efficiency of a mobile exchanging device is increased, and wherein, therefore, care is taken that no unnecessary waiting times occur at the reloading of the mobile exchanging device with coil cores, and that consequently the efficiency of the coil production machine thus remains high.

With the foregoing and other objects in view, there is provided in accordance with the invention, a coil producing machine with a mobile exchanging device for replacing fully wound coils with empty coil cores or partly wound coils, and with a stationary loading magazine for replenishing the empty coil cores or partly wound coils required by the exchanging device, comprising a mobile coil-core carrier, and means for automatically shuttling the carrier between the exchanging device and the loading magazine. As soon as the coil core carrier during its shuttle trip arrives at the stationary loading magazine, it couples itself, for example, automatically to the loading magazine, and accepts as many coil cores as it can carry. Then, it shuttles back to the mobile exchanging device, and couples itself to the magazine of the latter in order to fill the latter magazine with coil cores. If the mobile exchanging device changes its position during this operation, the connected or coupled coil-core carrier can travel with it, so that a position change does not interfere with or delay the coil core transfer.

It is not necessary for the mobile coil-core carrier to immediately shuttle back to the stationary loading magazine. If it still has a considerable supply of coil cores, it can remain coupled to the mobile exchanging device until its coil-core supply has been transferred or given up. Then it shuttles back to the stationary loading magazine, and the described operational steps can be repeated.

In accordance with another feature of the invention, there are provided coil winding devices and a rail arrangement disposed above the coil winding devices, the mobile exchanging device and the mobile coil-core carrier being mounted in common on the rail arrangement for travelling thereon. For reasons of economy both in cost and in space, avoidance of a separate rail system for the mobile coil-core carrier is desirable.

In accordance with a further feature of the invention, the mobile coil-core carrier has a magazine for coil cores, the magazine being selectively adjustable for accepting and delivering coil cores. During the free shuttle trip, the coilcore magazine remains closed.

Certain conventional coil producing machines wind the coils onto cylindrical cores or sleeves, while other coil producing machines wind the coils onto conical cores or sleeves. The handling or cylindrical cores or tubes is somewhat easier than the handling of conical cores or tubes, so that further developments of the invention to take in consideration, whether cylindrical or conical tubes or cores are being processed.

In accordance with an added feature of the invention, the coil-core magazine is constructed as a circular magazine and is rotatable around a horizontal axis. Naturally, the circular magazine can also have an axis with a slightly inclined orientation. A circular magazine of this type is in principle suited for cylindrical and for conical coil cores or sleeves. However, the loading and discharging of a circular magazine works better with cylindrical coil cores or sleeves, so that a circular magazine is especially well suited for this type of coil core or sleeve.

In conjunction with such a circular magazine and in accordance with an additional feature of the invention, the coil-core carrier is parked at a given level in a position for accepting coil cores, and the stationary loading magazine has a loading trough formed with side walls and a bottom for receiving therein coil cores in parallel, the loading trough being movable in an inclined position thereof up to the given level of the circular magazine of the mobile coil-core carrier. A loading trough of this type is particularly suited for cylindrical coil cores, or coil cores which are only slightly tapers; for extremely conical coil cores this arrangement is not well suited. The instant the loading trough is located in inclined position, in front of the circular magazine, the latter can be opened for filling in the tubes, and then can be slowly rotated, the coil cores sliding out from the loading trough into the circular magazine, if the latter has open pockets. A pocket of the circular magazine which is already filled cannot accept another coil core, so that the filling of the magazine is accomplished without problems, if it completes a rotation of 360 degrees.

The transfer of the stored coil cores to the mobile exchanging device proceeds in reversed sequence i.e. the mobile exchanging device can also have a trough-like magazine, but its inclination is not then towards the circular magazine of the coil-core carrier, but rather is directed opposite thereto. As the magazine is rotated, the coil cores roll out from the individual pockets under the action of gravity into the magazine trough of the mobile exchanging device, until the magazine trough is filled, and cannot accept more coil corees. After a rotation of 360 degrees, either the magazine of the mobile exchanging device is filled, or the circular magazine has discharged all its coil cores, if the capacity of the magazine of the mobile exchanging device is equal to or greater than the contents of the circular magazine.

For conical coil cores, other configurations or embodiments of the invention are recommended:

In accordance with yet a further feature of the invention, the coil-core magazine of the mobile coil-core carrier is constructed as a flat magazine having troughshaped storage nests for the coil cores. Each conical coil core lies alone in a troughshaped storage nest. From this coil core nesting position, the individual coil core can be further transferred in different ways. In order to achieve a compact and low configuration, it is of advantage, in accordance with an additional feature of the invention, to provide a coil producing machine, wherein the flat magazine has a controllable longitudinal coil-core pusher located at each coil-core nest, coil-core pusher having means for limiting the pushing force.

A coil core pusher of this type permits transfer of the coil cores in longitudinal direction thereof in one plane. The limiter of the pushing force ensures that no disturbances due to over-filling occur in the magazine nests of the mobile exchanging device, the reception areas of which remain occupied with coil cores. If the coil core which is to be transferred encounters any resistance, it remains in the storage nest of the mobile coil core carrier due to the limiting of the pushing force.

For the case of conical coil cores or sleeves, in accordance with yet a further feature of the invention, the stationary loading magazine has a controllable coil-core conveyor belt formed with individual troughs, the troughs, during a standstill phase of conveyor belt, being aligned with coil-core storage nests of the mobile coil-core carrier parked in coil-core receiving position, each individaul trough of the conveyor belt being positioned in front of a respective storage nest of the coil-core carrier, and being coordinated with a respective controllable longitudinal coil-core pusher, having the means for limiting the pusher force. The coil core conveyor belt allows the coil cores to be supplied from the side, whereas the further transfer of the coil cores to the mobile coil core carrier is effected in longitudinal direction of the coil cores in one plane. In this case also the limiting of the pushing force has the purpose of preventing over-filling of the magazine of the mobile coil- core carrier, or other problems.

Other features which are considered as characteristic for the invention are set forth in the appended claims.

Although the invention is illustrated and described herein as embodied in a coil producing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic plan view of a coil producing machine according to the invention;

FIG. 2 is a fragmentary enlarged side elevational view of a work station of the coil producing machine of FIG. 1 showing a mobile exchange device disposed thereabove;

FIG. 4 is a diagrammatic side elevational view of a mobile coil-core or tube-sleeve carrier with a circular magazine suited for cylindrical tube sleeves or coil cores shown at an instant when it receives tube sleeves or coil cores from the stationary loading magazine of FIG. 3;

FIG. 5 is a diagrammatic top plan view of the mobile tubesleeve or coil-core carrier shown in FIG. 4.

Figure 3:
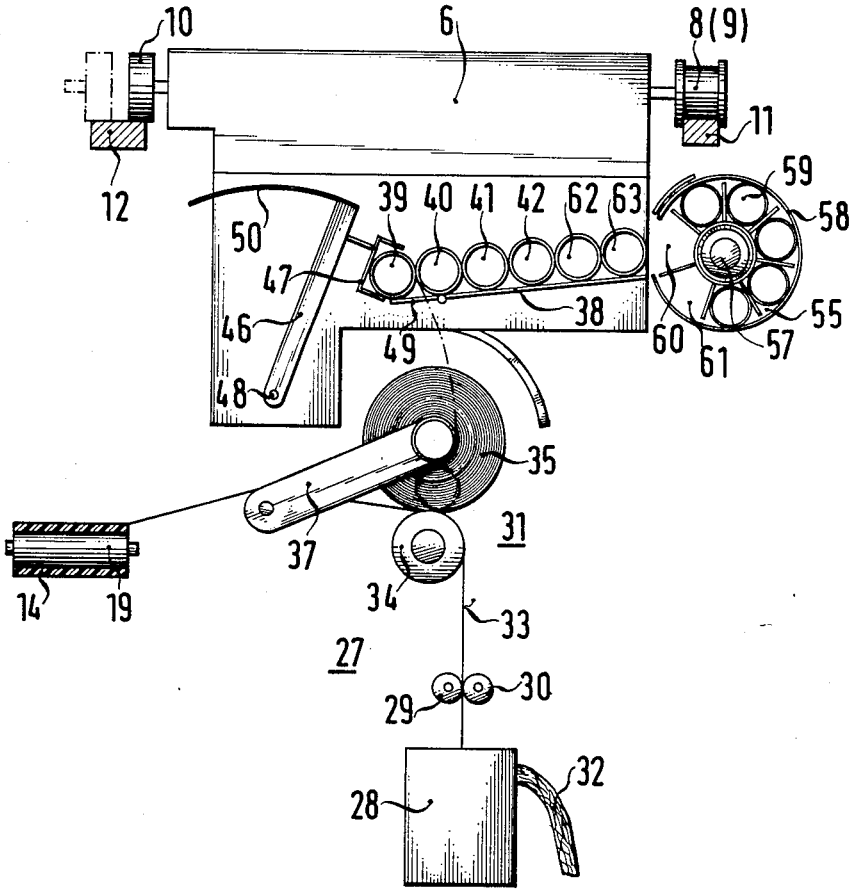
FIG. 3 is another view of FIG. 2 including a stationary loading magazine for supplying the coil producing machine with cylindrical coil cores or tubes.

Referring now to the drawing and first, particularly, to FIG. 1 thereof, there is shown, as a first embodiment of the invention, a bobbin or coil producing machine 1 with machine sides 2 and 3. The number of work stations is not apparent in FIG. 1, but it may be assumed that each side of the machine has about eighty work stations. At the left-hand side of FIG. 1, an end-frame 4 with a stationary loading magazine 5 is located, which serves for supplying a mobile exchanging device 6 with required coil cores or tubes. The exchanging device has its own magazine 7 for a limited supply of coil cores or sleeves.

The exchanging device 6 has two travel rollers 8 and 9 in front, and a support roller 10 in the rear. One of the two mentioned travel rollers 8 and 9 is drivable. The rollers 8 and 9 rest on a rail 11, which initially runs along the machine side 2 above the work stations, then describes a circular arc and continues along the machine side 3. The other rail 12 starts above the loading magazine 5, and ends at a platform 13 at the right-hand side of the machine.

The rail 12 is disposed over the middle of the machine. A coil or bobbin conveyor belt 14 lies below the rail 12, and three fully wound coils 15, 16 and 17 have been deposited on this belt. It is an endless conveyor belt, which is guided over rollers 18 and 19 (FIG. 2). The coil conveyor belt 14 extends through the end frame 4, and ends at a coil deposit station 20, on which four coils have already been deposited.

The mobile exchanging device 6 is, in fact, actually travelling in direction of the arrow 22. At the end of the straight travel portion it will later travel in a semi-circle, the support roller 10 rotating 180 degrees on a platform 13, and thereafter the mobile exchanging device 6 continues to travel straight ahead along the machine side 3.

The mobile exchanging device 6 is followed by a likewise mobile coil-core or tube carrier 23, which has received beforehand several coil cores from the loading magazine 5 in order to transport them to the mobile exchanging device 6. The coil-core carrier 23 also has two travel rollers 24 and 25, one of which is drivable. Furthermore, the coil-core carrier 23 is provided at its rear with a support roller 26. Both devices 6 and 23 are arranged so as to be able to travel on the same rail system. The travel speed of the mobile coil-core carrier 23 is greater than the travel speed of the mobile exchanging device 6, so that the carrier 23 will soon be coupled to the exchanging device 6 to discharge its coil cores. This can only occur during the straight travel portion, or when the mobile exchanging device stands still. A conventional blocking device, similar to that used in U.S. Pat. No. 4,283,908, prevents one of the two devices from travelling on the circular path in mutually coupled state. Furthermore, a blocking prevents the other of the two devices from starting on the circular path as long as the device ahead of it is still on its circular travel.

The coil-core producing machine 1 is constructed in the form of an open-end rotor spinning machine. According to FIG. 2 and FIG. 3, the illustrated individual work station 27 therefore includes a spinning device 28, a draw-off roller pair 29, 30, and a winding device 31. In the spinning device 28, fiber sliver 32 is spun into a thread 33.

The winding device 31 includes a winding drum 34, on which the coil 35 rolls. This coil 35 is wound on a cylindrical core or tube 36 which is carried by a swingable coil frame 37.

The mobile exchanging device 6 has a flat magazine 38 which is inclined from the front towards the rear thereof. According to FIG. 2, it contains four cylindrical coil cores or tubes 39 to 42, and has two empty positions 43 and 44 shown in phantom.

The thread 33 moves over and between the pair of draw-off rollers 29 and 30, and is wound on the coil 35. The mobile exchanging device 6 stands ready to change coils. During the coil exchange, the spinning process is interrupted, and the coil core or tube 36 is released from the holder of the coil frame 37, a coil ejector 45 simultaneously swinging towards the left-hand side, and imparting enough acceleration to the coil 35, so that it rolls on the coil conveyor belt 14. Thereafter a feeder 46 is activated, which has the function of feeding the next coil core 39 of the flat magazine 38 to the coil frame 37. A gripper 47 grips the coil core 39, and the feeder 46 swings downwardly thereafter around a pivot point 48. Thereby, a resiliently closed flap or shutter of the flat magazine 38, 49 opens by moving downwardly and releases the coil core or tube 39. The feeder 46 is pivoted at the rear side thereof with a guide wire 50, which prevents additional coil cores 40 and 41 from rolling down during the swing of the feeder 46.

The coil cores or tube 39 is brought by the feeder 46 into the position 39' thereof shown in phantom, is clamped by the coil frame 37 in this position, and placed on the coil drum 34. Then the feeder 46 swings back to the starting position thereof shown in FIG. 2. During this swinging movement, the flap 49 closes again, and the next following coil core 40 can then take the place occupied before by the coil core 39. All of the other coil cores in the flat magazine 38 advance one position farther.

Before the takeover of the coil cores from the mobile coil-core carrier 51 is explained with the aid of FIG. 3, this mobile coil- core carrier 51 will be explained in greater detail with respect to FIGS. 4 and 5.

The coil- core carrier 51 has a construction deviating from the construction of the part 23 in FIG. 1. The coil-core carrier 51 is able to travel on the rails 11 and 12. It has two travel rollers 52 and 53 in front, and a support roller 54 in the rear. A coil- core magazine 55 is constructed in the form of a circular magazine. It projects out of the housing of the coilcore carrier 51 to such an extent that it is aligned with the flat magazine 38 of exchanging device 6 during the transfer of the coil cores.

The circular magazine 55 has a seven-pointed star or spider 56 which is fastened to a shaft 57 which is rotatable counterclockwise. The seven-pointed star 56 forms seven chambers in the cylindrical housing 58 of the circular magazine 55, each of the chambers being capable of receiving a coil core or tube therein. The loading and emptying of the circular magazine 55 occurs from the side, in fact, from the left-hand side, as viewed in FIG. 3.

In FIG. 3, only the circular magazine 55 of the mobile coil-core carrier 51 is shown. It is already aligned with the flat magazine 38. As the circular magazine 55 is moved into position in front of the flat magazine 38, a part of the chamber wall having the width of one of the chambers is automatically opened like a sliding door, so that, through the then open left-hand wall of the housing 58, the coil core 59 can roll from the circular magazine 55 into the flat magazine 38, the instant the shaft 57 is slowly turned counter-clockwise.

For each coil-core tranfser, the shaft 57 completes a rotation of 360 degrees. In FIG. 3, it is assumed that the shaft 57 is in the process of turning. The chambers 60 and 61 of the circular magazine 55 have already transferred their coil cores 62 and 63, respectively, to the flat magazine 38. The flat magazine cannot accept more coil cores, so that, as the shaft 57 continues to turn, the coil cores 59, which are still disposed in the circular magazine 55, remain there and slide off the coil cores already located in the flat magazine 38, respectively.

FIG. 4 shows that the stationary loading magazine 64 has a swingable loading trough 68, with side walls 65 and a bottom 66, containing coil cores 67 disposed in mutually parallel arrangement. The loading trough 68 is mounted so as to be swingable about a pivot point 69. In rest position, the loading trough 68 lies somewhat lower than as shown in FIG. 4, so that the foremost coil core 67' lies in front of a wall 70. After the left-hand wall portion of the housing 58 of the circular magazine 55 is opened for the purpose of transferring the next coil core, a pneumatic adjusting motor 71 is activated by compressed air, thereby lifting the loading trough 68 to the position shown in FIG. 4. The instant the shaft 57 slowly rotates counter-clockwise, the coil cores disposed on the loading trough 68 roll successively into the free or empty chambers of the circular magazine 55. According to FIG. 4, this has already happened, and the circular magazine 55 is filled. After the transfer of the coil cores 72, the mobile coil-core carrier 51 can start to travel farther, whereby the slide-like opened wall portion of the housing 58 automatically closes again. At the same time, the loading trough 68 is lowered again, and the wall 70 prevents the coil cores 67 from rolling out of the trough 68.

Figure 6:
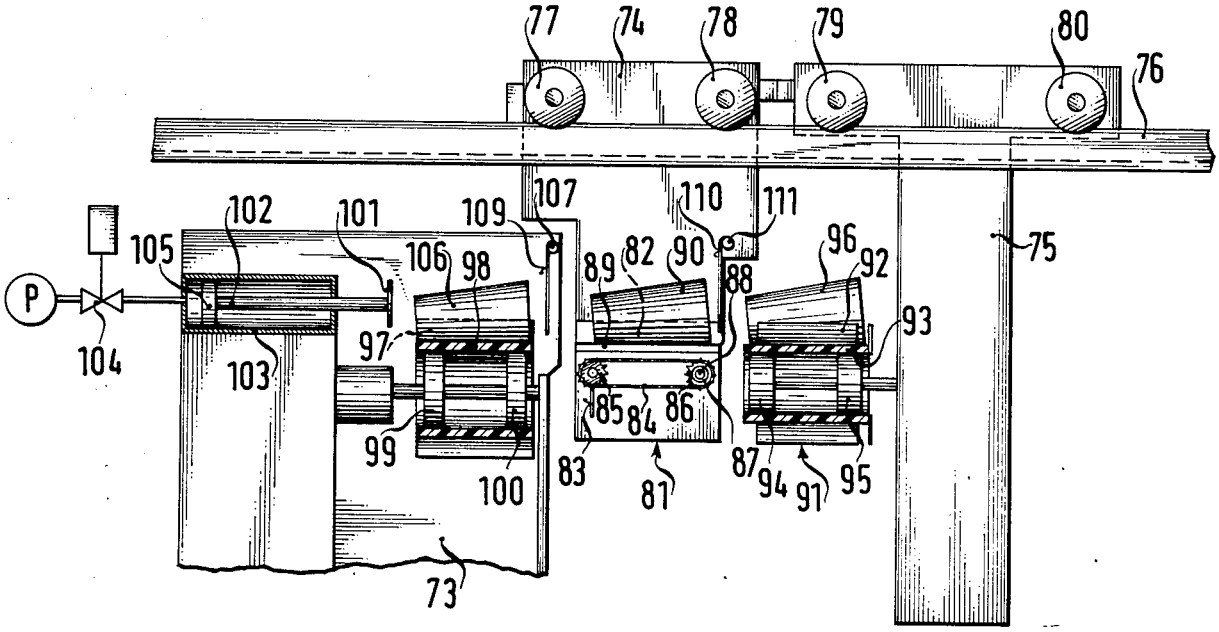
FIG. 6 is a diagrammatic front elevational view of another embodiment of the stationary loading magazine, the mobile coil-core or tube carrier, and the mobile exchanging device.

In a further embodiment of the invention according to FIG. 6, a coil producing machine includes among other features a stationary loading magazine 73, a mobile core or tube carrier 74, and a mobile core-exchanging device 75. FIG. 6 shows travel rollers 77 and 78, as well as 79 and 80, respectively, of the mobile devices. The coil-core carrier 74 is, in fact, located in a position which permits a coil-core transfer from the loading magazine 73, and also permits a further coil-core transfer to the exchanging device 75.

In this case, the coil-core magazine 81 of the mobile core carrier 74 is constructed as a flat magazine having trough-shaped storage nests 82 for the coil cores. The individual core storage nests 82 lie in one plane, one behind the other, so that in FIG. 6 only the foremost nest 82 is visible.

Each core storage nest 82 of the flat magazine 81 is provided with a controllable coil-core slider or pusher 83, which is mounted on an endless chain 84 guided by sprocket wheels 85 and 86. The sprocket wheel 86 is driven by a friction clutch 87 which serves as a force limiter for the pusher 83. All of the friction clutches and pushing force limiters 87, respectively, are driven by a common shaft 88. The instant the chain 84 beings to run, the coil-core pusher 83, which is in the form of a pin and extends through a slot 89 in the bottom of the nest 82, moves in front of the tapered end of a conical coil core 90 which lies in the nest 82 and pushes the coil core 90 axially into the flat magazine 91 of the mobile exchanging device 75. The flat magazine 91 also has nests 92, for example, for receiving coil cores, these nests 92 being assembled on an endless belt 93. The belt 93 travels over rollers 94 and 95. With the aid of this belt 93, the conical coil cores 96, which are disposed in the flat magazine 91, can be supplied stepwise to a feeder of the mobile exchanging device 75.

The stationary loading magazine 73 has a controllable coil-core conveyor belt 98 which is provided with individual trough 97, the conveyor belt 98 travelling over rollers 99 and 100. The individual troughs 97 all lie in one plane, behind one another so that only the foremost trough 97 is visible in FIG. 6. (In the interest of clarity, the coil-core conveyor belt 98 as well as the endless belt 93 of the flat magazine 91 are shown in cross section). When the coil-core conveyor belt 98 is at rest, the individual troughs 97 are in alignment with the core storage nests 82 of the mobile coil-core carrier 74, which is then parked ready to accept coil cores.

Each individual trough 97 of the conveyor belt 98 which is positioned in front of a core storage nest 82 of the core or tube carrier 74, is coordinated with a controllable slider 101 extending in longitudinal direction of the respective coil core. This slider 101 is seated on a piston rod 102 of a pneumatic adjusting motor or actuator 103. The pneumatic adjusting motor 103 is connected via a control valve 104 to a source P of pressurized air, which serves as a pushing force limiter due to the adjustability of the air pressure.

After the control valve 104 is activated, the piston 105 of the pneumatic adjusting motor 103 moves to the right-hand side, as viewed in FIG. 6, and thereby entrains the coil-core slider 101 via the piston rod 102. The slider 101 pushes a conical coil core 106 disposed in the trough 97 to the right-hand side, whereby a flap 109 which swings about a pivot 107 is entrained thereby. If a coil core 90 should lie in the nest 82, as shown in FIG. 6, the flap 109 encounters resistance, and the coil core 106 cannot be pushed from the trough 97 into the nest 82. Due to the pushing force limitation, the coil-core pusher or slider 101 does not complete its full stroke.

The slide transfer of the conical coil cores or tubes from the stationary loading magazine 73 into the coil-core magazine 81 can only succeed at the free or vacant storage places in the coil-core magazine 81. During the core or tube transfer, a flap 110 which is swingable about the pivot point 98 is blocked, so as to prevent coil cores or tubes from falling off at the side. After the coil-core transfer, all of the flaps 109 are set back into vertical position so as to dispose or store the non-transferred coil cores again correctly in the individual troughs 97.

For the purpose of transferring the coil cores from the mobile coil-core carrier into the flat magazine 91 of the mobile exchanging device 75, the shaft 86 is slowly rotated clockwise by a drive, whereby the sprocket wheels 86 are entrained by means of the sliding or pushing force limiter 87. The coil-core pushers or sliders 83 try to slide the conical coil cores 90 located in the coil-core nests 82 towards the right-hand side into the coil-core nests 92 of the flat magazine 91. According to FIG. 6, for example, the coil core or sleeve 90 entrains the flap 110, which will lie against the coil core 96, so that the transfer cannot take place. Because of the friction clutch 87, the force of the coil-core pusher 83 is limited. After the termination of the transfer operation which lasts for a predetermined time, the flaps 110 are set back to the vertical position thereof again, in order to store the non-transferred coil cores 90 again correctly in their positions in the nests 82. The shaft 88 is turned back counterclockwise, until all of the coil-core pushers 83 are on the lower course or section of the chains 84.

The invention is not to be limited to the illustrated and described specific embodiments which were used merely by way of example.

The shuttling of the mobile coil-core or sleeve carrier can be arranged for an operational mode dependent on demand, or it can be operating in a mode which is independent of demand.

In the operating mode independent of demand, the mobile coilcore carrier shuttles continuously between the stationary loading magazine and the mobile exchanging device, and attempts each time to accept and deliver, respectively, as many coil cores as possible.

In the operating mode dependent upon demand, the mobile coilcore carrier, for example, remains coupled in the vicinity of and with the exchanging device, respectively, as long as it still contains coil cores, and shuttles back to the stationary loading magazine only to accept new coil cores and to feed new coil cores to the mobile exchanging device.

For the purpose of accepting or transferring coil cores, a circular magazine, instead of continuously rotating 360 degrees, can also advance or rotate further discontinuously stepwise until all its storage places have passed the transfer and acceptance locations, respectively.

There are claimed:

1. Coil producing machine with a mobile exchanging device for replacing fully wound coils with empty coil cores or partly wound coils, and with a stationary loading magazine for replenishing the empty coil cores or partly wound coils required by the exchanging device, comprising a mobile coil-core carrier, means for automatically shuttling said carrier between the exchanging device and the loading magazine, a pair of mutually spaced rails, and a plurality of coil winding devices disposed along and below said pair of rails, the mobile exchanging device and said mobil coil-core carrier being mounted in common on said pair of rails for travelling thereon, both said mobile coil-core carrier and the mobile exchanging device have respective magazines for coil cores, said magazine of said mobile coil core carrier being selectively displaceable into a position adjacent the stationary loading magazine for accepting coil cores therefrom and into a position adjacent the mobile exchanging device for delivering the coil cores thereto, and said magazine of the mobile exchanging device being selectively engageable with said mobile coil core carrier for receiving coil cores therefrom, and displaceable into a position adjacent the coil winding devices, respectively, for delivering the coil cores thereto.

2. Coil producing machine according to claim 1, wherein said coil-core magazine of said mobile coil-core carrier is constructed as a circular magazine and is rotatable around a horizontal axis.

3. Coil producing machine according to claim 1, wherein said coil-core magazine of said mobile coil-core carrier is constructed as a flat magazine having trough-shaped storage nests for the coil cores.

4. Coil producing machine according to claim 3, wherein said flat magazine has a controllable longitudinal coil-core pusher located at each coil-core nest, said coil-core pusher having means for limiting the pushing force.

5. Coil producing machine according to claim 2, wherein said coil-core carrier is parked at a given level in a position for accepting coil cores, and the stationary loading magazine has a loading trough formed with side walls and a bottom for receiving therein coil cores in parallel, said loading trough being movable in an inclined position thereof up to said given level of said circular magazine of said mobile coil-core carrier.

6. Coil producing machine according to claim 4, wherein the stationary loading magazine has a controllable coil-core conveyor belt formed with individual troughs, said troughs, during a standstill phase of said conveyor belt, being aligned with coil-core storage nests of the mobile coil-core carrier parked in coil-core receiving position, each individual trough of said conveyor belt being positioned in front of a respective storage nest of said coil-core carrier, and being coordinated with a respective controllable longitudinal coil-core pusher, having said means for limiting the pusher force.

* * * * *